US008342468B1

(12) United States Patent
Strickland

(10) Patent No.: US 8,342,468 B1
(45) Date of Patent: Jan. 1, 2013

(54) DRINK CONTAINER HOLDING DEVICE

(76) Inventor: Mark B. Strickland, Thousand Oaks, CA (US)

( * ) Notice: Subject to any disclaimer, the term of this patent is extended or adjusted under 35 U.S.C. 154(b) by 423 days.

(21) Appl. No.: 11/533,566

(22) Filed: Sep. 20, 2006

(51) Int. Cl.
*A47K 1/08* (2006.01)

(52) U.S. Cl. ..... 248/311.2; 248/309.1; 248/313; 248/316.1; 224/148.1; 224/148.4; 224/282; 224/679

(58) Field of Classification Search ..... 248/309.1, 248/311.2, 313, 316.1, 315, 689, 690, 226.11, 248/227.3, 230.5, 231.61, 292.12, 229.1, 248/229.14, 229.15, 229.25, 228.6, 230.1, 248/230.6, 231.71; 224/148.1, 148.4, 148.7, 224/282, 679, 926; 403/289, 290, 398, 97; 220/703, 737
See application file for complete search history.

(56) References Cited

U.S. PATENT DOCUMENTS

| | | | | | |
|---|---|---|---|---|---|
| 625,032 | A | * | 5/1899 | Homan | 248/230.4 |
| 663,121 | A | * | 12/1900 | Frost | 248/230.4 |
| 1,600,027 | A | * | 9/1926 | Welsand | 224/223 |
| 3,414,311 | A | * | 12/1968 | Trimboli | 294/34 |
| 4,436,232 | A | * | 3/1984 | Zane et al. | 224/462 |
| 4,437,596 | A | * | 3/1984 | Shook | 224/414 |
| 4,449,654 | A | * | 5/1984 | Cappis | 224/148.6 |
| 4,535,921 | A | * | 8/1985 | Sanders | 223/106 |
| 4,702,446 | A | * | 10/1987 | Brown | 248/210 |
| 4,765,581 | A | * | 8/1988 | Wallace et al. | 248/311.2 |
| 4,883,205 | A | * | 11/1989 | Saelens et al. | 224/414 |
| 4,993,611 | A | * | 2/1991 | Longo | 224/148.4 |
| 5,244,114 | A | * | 9/1993 | Traegde | 220/737 |
| 5,249,770 | A | * | 10/1993 | Louthan | 248/311.2 |
| 5,294,028 | A | * | 3/1994 | Bankroff | 224/148.5 |
| 5,301,634 | A | * | 4/1994 | Ho | 119/477 |
| 5,312,037 | A | * | 5/1994 | Hand | 237/12.3 C |
| 5,337,907 | A | * | 8/1994 | McKenzie et al. | 211/88.01 |
| 5,362,022 | A | * | 11/1994 | McLoughlin et al. | 248/313 |
| 5,425,484 | A | * | 6/1995 | Kawand et al. | 224/414 |
| 5,427,285 | A | * | 6/1995 | Kreitzman | 224/414 |
| 5,441,225 | A | * | 8/1995 | Hall | 248/231.61 |
| 5,454,497 | A | * | 10/1995 | Kettelson | 224/148.6 |
| 5,464,183 | A | * | 11/1995 | McConnell et al. | 248/311.2 |
| 5,474,273 | A | * | 12/1995 | Vinal | 248/311.2 |
| 5,484,129 | A | * | 1/1996 | Megal | 248/311.2 |
| D370,835 | S | | 6/1996 | Nachtrab | |
| 5,598,995 | A | * | 2/1997 | Meuth et al. | 248/74.3 |
| 5,864,289 | A | * | 1/1999 | Tiemann | 340/568.7 |
| 6,053,340 | A | * | 4/2000 | Cameron | 211/85.7 |
| 6,231,058 | B1 | * | 5/2001 | Kimbrough et al. | 280/33.992 |
| 6,505,802 | B2 | * | 1/2003 | Fowler | 248/311.2 |
| 6,588,440 | B2 | * | 7/2003 | Varnado | 135/90 |
| 6,588,716 | B1 | | 7/2003 | Heid | |
| 6,726,069 | B2 | * | 4/2004 | Machover | 224/148.7 |
| 6,752,279 | B1 | | 6/2004 | Dwyer | |
| 6,802,484 | B1 | * | 10/2004 | Kiley et al. | 248/311.2 |
| 6,983,918 | B1 | * | 1/2006 | Leasure | 248/311.2 |
| 7,063,298 | B2 | * | 6/2006 | Henry | 248/309.1 |
| 7,090,183 | B2 | * | 8/2006 | Heybl et al. | 248/314 |

(Continued)

*Primary Examiner* — Ramon Ramirez
*Assistant Examiner* — Todd M. Epps
(74) *Attorney, Agent, or Firm* — Kristina Castellano; Castellano PLLC

(57) ABSTRACT

A drink container holding device for permitting articles and a beverage to be stored on a music stand includes a frame. At least one mounting assembly is coupled to the frame. The mounting assembly engages the stand to mount the frame to a stand. A sleeve is coupled to the frame. The sleeve has a beverage aperture extending therein through an upper end of the sleeve. The beverage aperture receives a drink container to allow the sleeve to support the drink container adjacent to the stand when the frame is mounted on the stand.

12 Claims, 14 Drawing Sheets

U.S. PATENT DOCUMENTS

| | | | | |
|---|---|---|---|---|
| 7,156,353 | B2 * | 1/2007 | Kringel et al. | 248/311.2 |
| 7,226,029 | B2 * | 6/2007 | Hoshi | 248/311.2 |
| 7,275,729 | B2 * | 10/2007 | Sherman et al. | 248/311.2 |
| 8,033,518 | B2 * | 10/2011 | Schuchman | 248/311.2 |
| 2001/0013568 | A1 * | 8/2001 | Berenguer | 248/311.2 |
| 2003/0094556 | A1 * | 5/2003 | Meggiolan | 248/311.2 |
| 2007/0012706 | A1 * | 1/2007 | Deadman | 220/737 |
| 2007/0080274 | A1 * | 4/2007 | Ouellette | 248/310 |
| 2007/0210229 | A1 * | 9/2007 | Brenner et al. | 248/311.2 |
| 2007/0267551 | A1 * | 11/2007 | Townsend | 248/125.8 |

* cited by examiner

DRINK CONTAINER HOLDING DEVICE

BACKGROUND OF THE INVENTION

1. Field of the Invention

The present invention relates to stand accessory holders and more particularly pertains to a new stand accessory holder for permitting articles and a beverage to be stored or supported on a music stand.

2. Description of the Prior Art

The use of stand accessory holders is known in the prior art. The prior art commonly teaches a system of clamps and platforms being coupled to a stand to allow articles to be stored on the stand.

While these devices fulfill their respective, particular objectives and requirements, the need remains for a device that has certain improved features that allow the device to be readily removed from a stand and moved to another stand. Additionally the device can accommodate a stand that is positioned at an angle while maintaining a substantially vertical orientation of the device.

SUMMARY OF THE INVENTION

The present invention meets the needs presented above by generally comprising a frame. At least one mounting assembly is coupled to the frame. The mounting assembly engages the stand to mount the frame to a stand. A sleeve is coupled to the frame. The sleeve has a beverage aperture extending therein through an upper end of the sleeve. The beverage aperture receives a drink container to allow the sleeve to support the drink container adjacent to the stand when the frame is mounted on the stand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
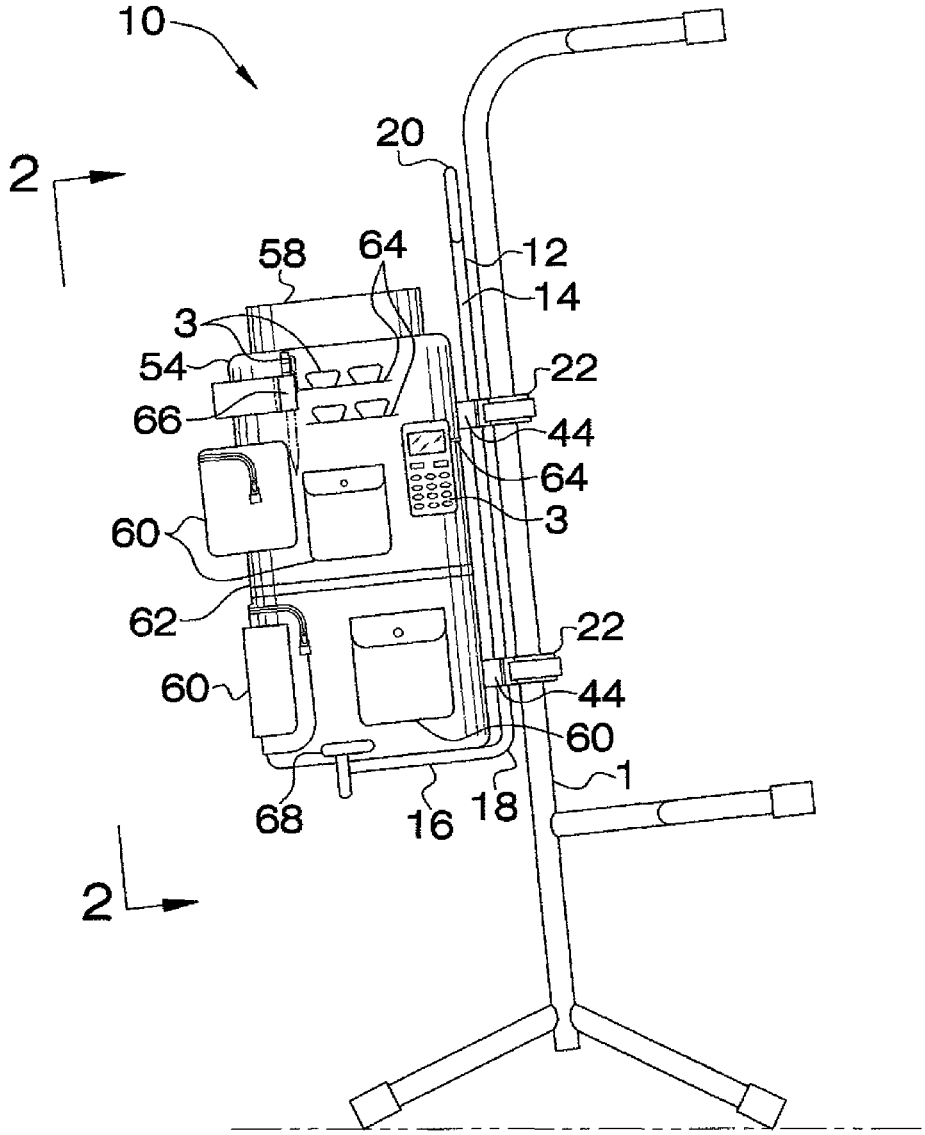
FIG. 1 is a right side view of a drink container holding device according to the present invention shown mounted to a stand.
Figure 2:
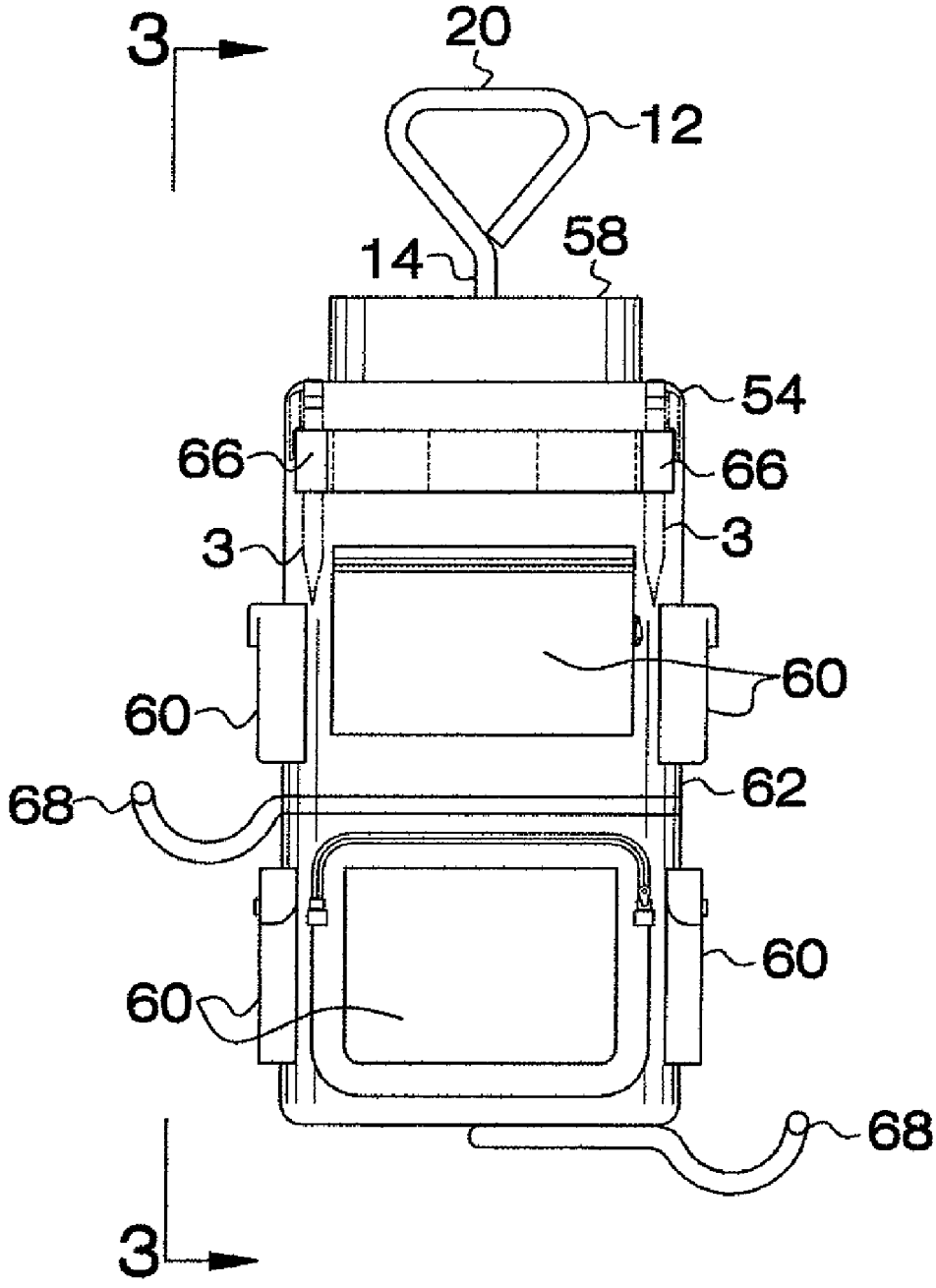
FIG. 2 is a front view of the present invention.
Figure 3:
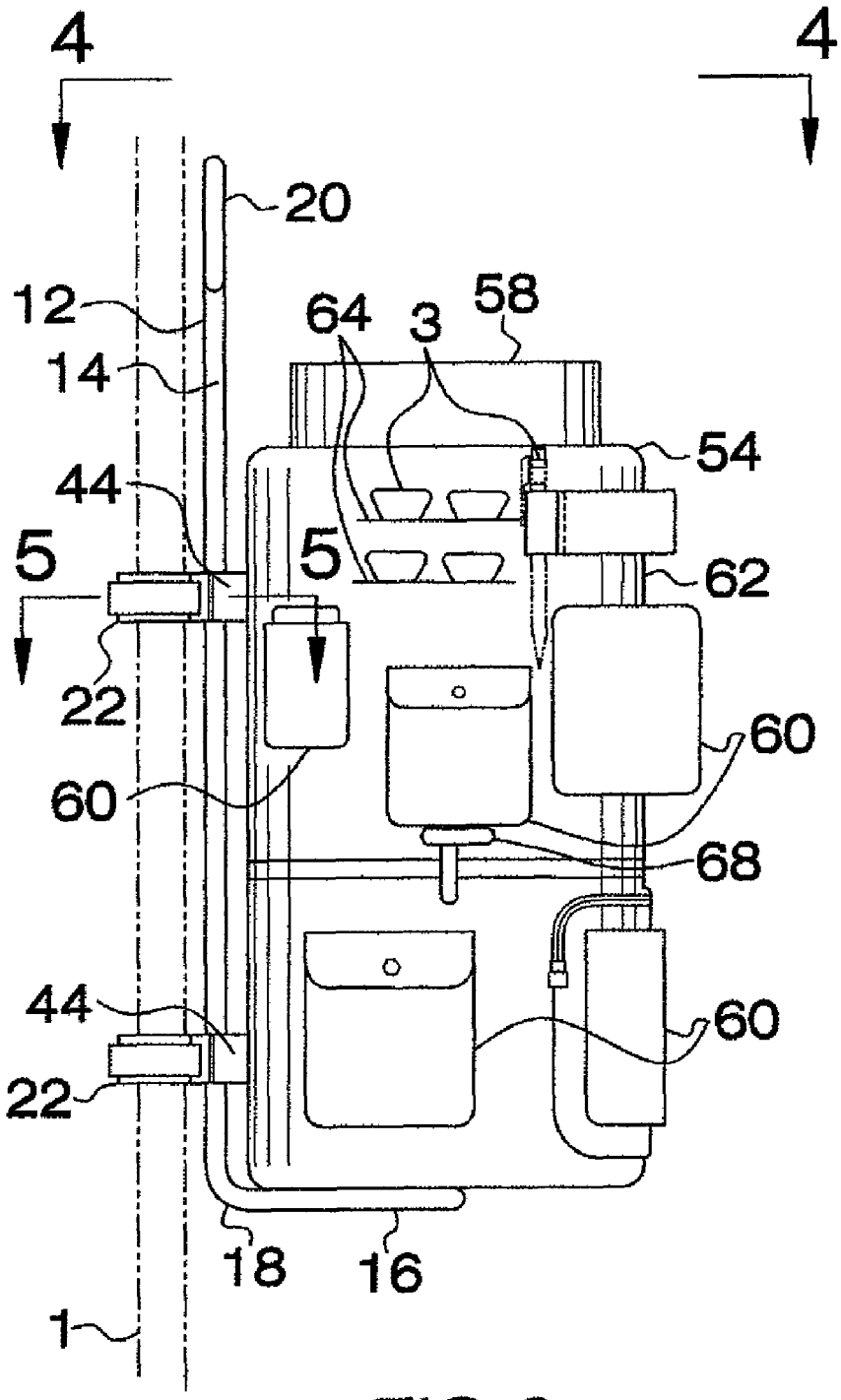
FIG. 3 is a left side view of the present invention.

With reference now to the drawings, and in particular to FIGS. 1 through 11 thereof, a new stand accessory holder embodying the principles and concepts of the present invention and generally designated by the reference numeral 10 will be described.

As best illustrated in FIGS. 1 through 11, the drink container holding device 10 generally comprises a frame 12 including a stanchion portion 14 extending substantially parallel to a stand 1 when the frame 12 is mounted to the stand 1. A lateral portion 16 is coupled to a bottom end 18 of the stanchion portion 14 and extends substantially orthogonally to the stanchion portion 14. The lateral portion 16 extends away from the stand 1 when the stanchion portion 14 is mounted to the stand 1. A handle loop 20 is coupled to the stanchion portion 14 opposite the lateral portion 16. The handle loop 20 is graspable to facilitate lifting of the frame 12 when the frame 12 is removed from the stand 1 or to lift the stand 1 as well as the frame 12.

Figure 4:
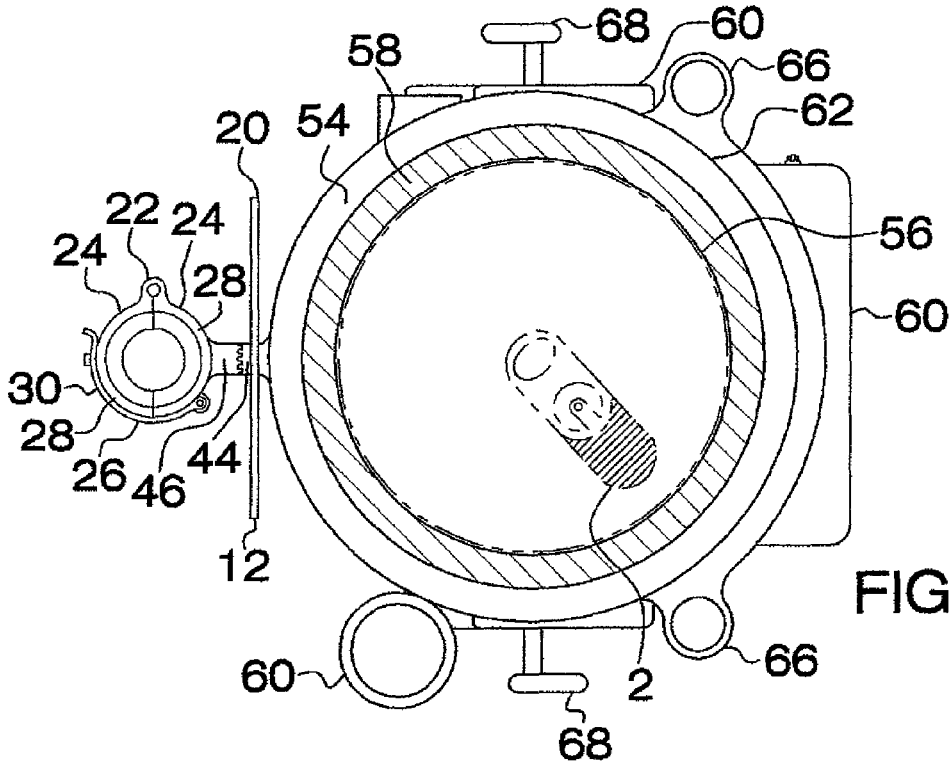
FIG. 4 is a top view of the present invention.
Figure 5:
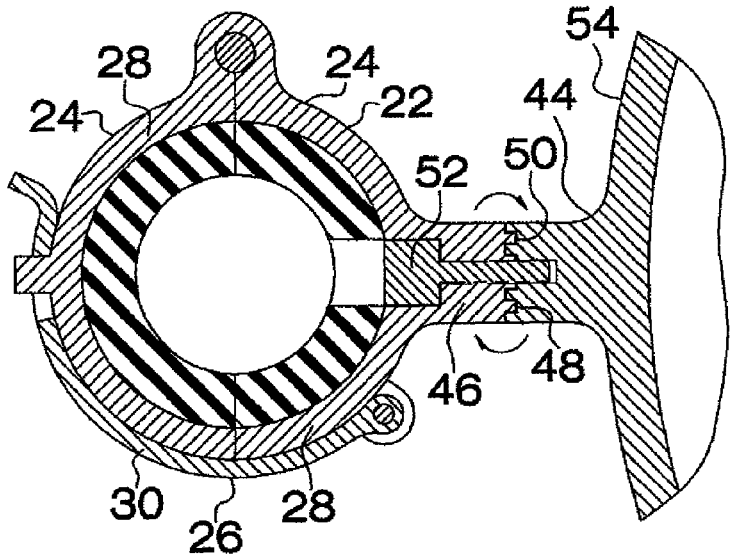
FIG. 5 is a cross-sectional view of the present invention taken along line 5-5 of FIG. 3.
Figure 6:
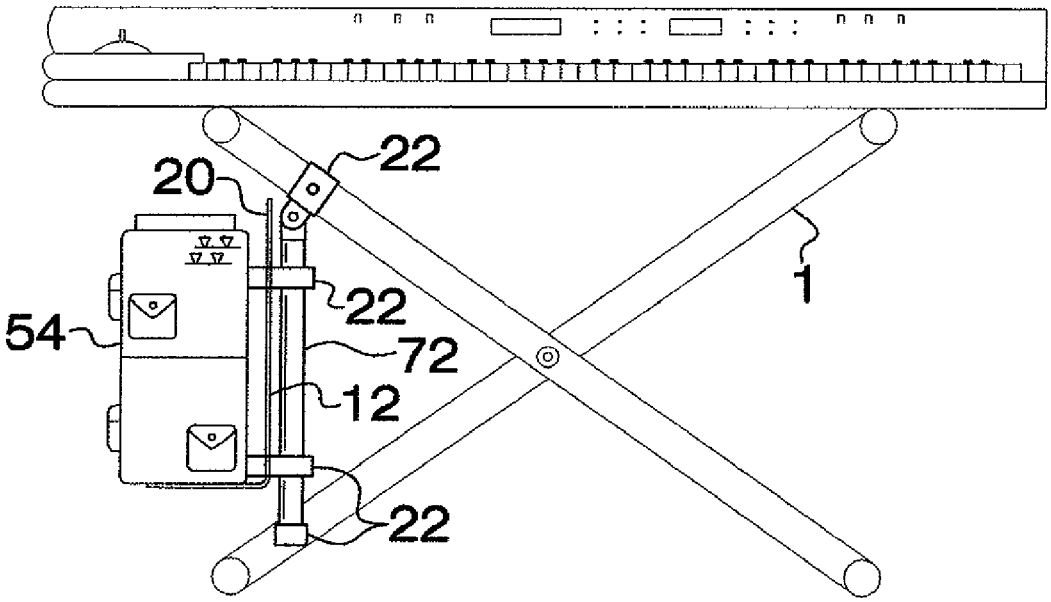
FIG. 6 is a front view of the present invention shown in place on X-shaped stand.

Each of a plurality of mounting assemblies 22 is coupled to the frame 12. The mounting assemblies 22 each engage the stand 1 to mount the frame 12 to the stand 1. Each of the mounting assemblies 22 is positioned on the stanchion portion 14 of the frame 12. Each of the mounting assemblies 22 includes a plurality of clamping arms 24. Each of the clamping arms 24 is extendable around a portion of the stand 1. A securing portion 26 is coupled to one of the clamping arms 24 and selectively engages the other one of the clamping arms 24. The securing portion 26 forces the clamping arms 24 against the stand 1 to frictionally secure the clamping arms 24 to the stand 1. As shown in FIGS. 4 and 5, the clamping arms 24 may include a pair of C-shaped clamps 28 pivotally coupled to one another to extend around the stand 1 with the securing portion 26 being a lever arm 30 pivotally coupled to one of the clamps 28 and engaging the other one of the clamps 28 to secure the clamps 28 together around the stand 1.

Figure 7:
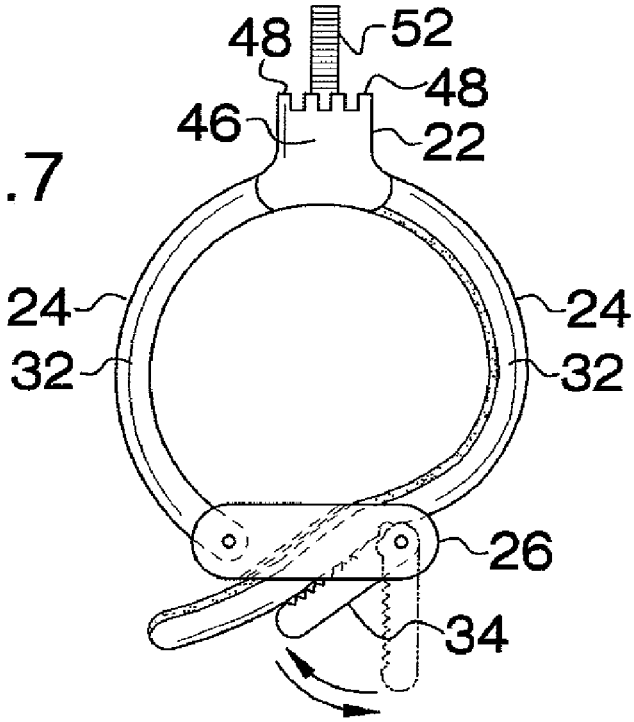
FIG. 7 is a top view of an embodiment of the mounting assemblies of the present invention.
Figure 8:
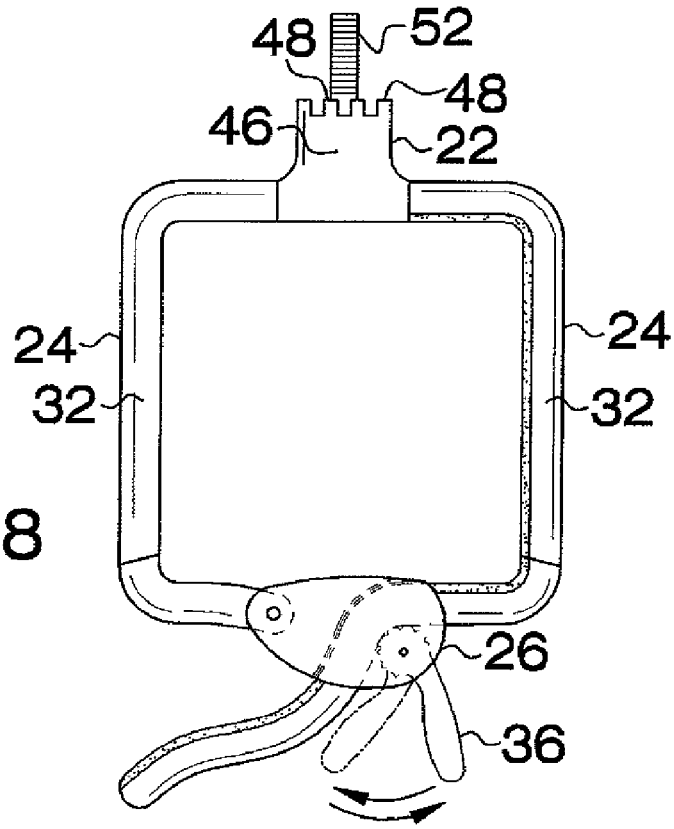
FIG. 8 is a top view of an embodiment of the mounting assemblies of the present invention.
Figure 9:
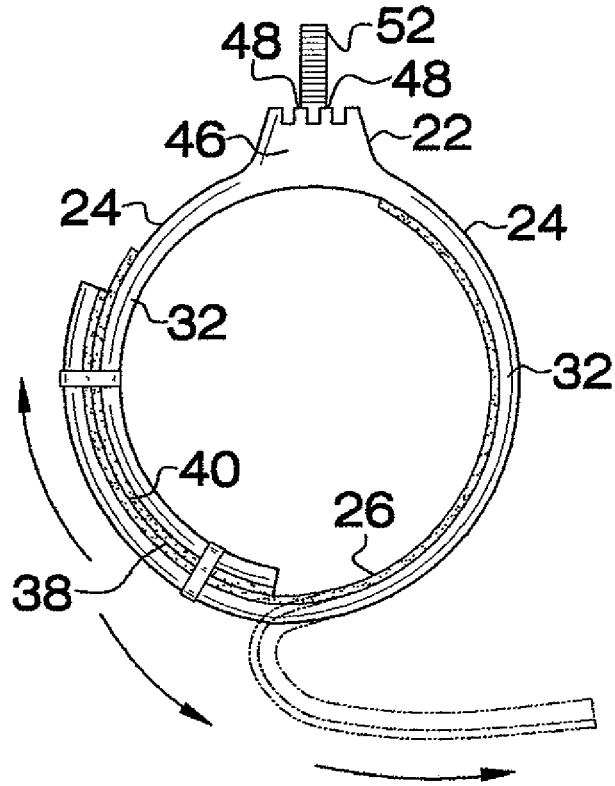
FIG. 9 is a top view of an embodiment of the mounting assemblies of the present invention.
Figure 10:
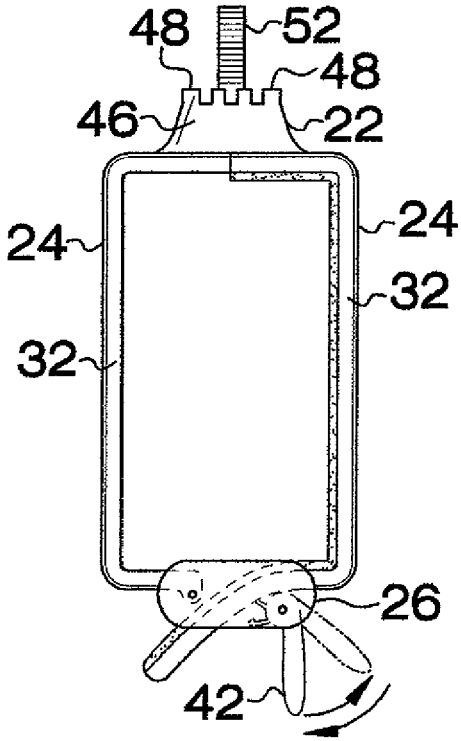
FIG. 10 is a top view of an embodiment of the mounting assemblies of the present invention.

FIGS. 7 through 10 show the clamping arms 24 including a pair of flexible straps 32 to extend around and conform to the stand 1 with each of the flexible straps 32 including a rubber coating to facilitate frictional contact between the flexible straps 32 and the stand 1. FIG. 7 shows the securing portion 26 being comprised of a cam buckle 34 for engaging one of the flexible straps 32 to secure the flexible straps 32 around the stand 1. FIG. 8 shows the securing portion 26 being comprised of a ratchet lever 36 engaging one of the flexible straps 32 to tighten and secure the flexible straps 32 around the stand 1. FIG. 9 shows the securing portion 26 being a first portion of hook and loop fastener 38 coupled to one of the flexible straps 32 and a second portion of hook and loop fastener 40 coupled to the other one of the flexible straps 32 and being complimentary to the first portion of hook and loop fastener 38 to secure the flexible straps 32 around the stand 1. FIG. 10 shows the securing portion 26 being comprised of a clip buckle 42 engaging one of the flexible straps 32 to tighten and secure the flexible straps 32 around the stand 1.

Each of the mounting assemblies 22 additionally includes a base portion 44 coupled to the frame 12. The base portion 44 extends orthogonally from the stanchion portion 14 toward the stand 1 when the frame 12 is mounted to the stand 1. A neck portion 46 is coupled to at least one of the clamping arms 24. The neck portion 46 is rotatably coupled to the base portion 44. The neck portion 46 is rotatable with respect to the base portion 44 to adjust an angle of the clamping arms 24 with respect to the frame 12 to maintain the frame 12 in a substantially vertical orientation when mounted to the stand 1. The neck portion 46 has a plurality of indexing pins 48 outwardly extending from the neck portion 46. Each of the indexing pins 48 is inserted into one of a plurality indexing slots 50 in the base portion 44 to permit orientation of the neck portion 46 and the clamping arms 24 at desired angles with respect to the frame 12. A threaded fastener 52 slidably extends through the neck portion 46 and threadably engages the base portion 44 to secure the neck portion 46 to the base portion 44.

Figure 11:
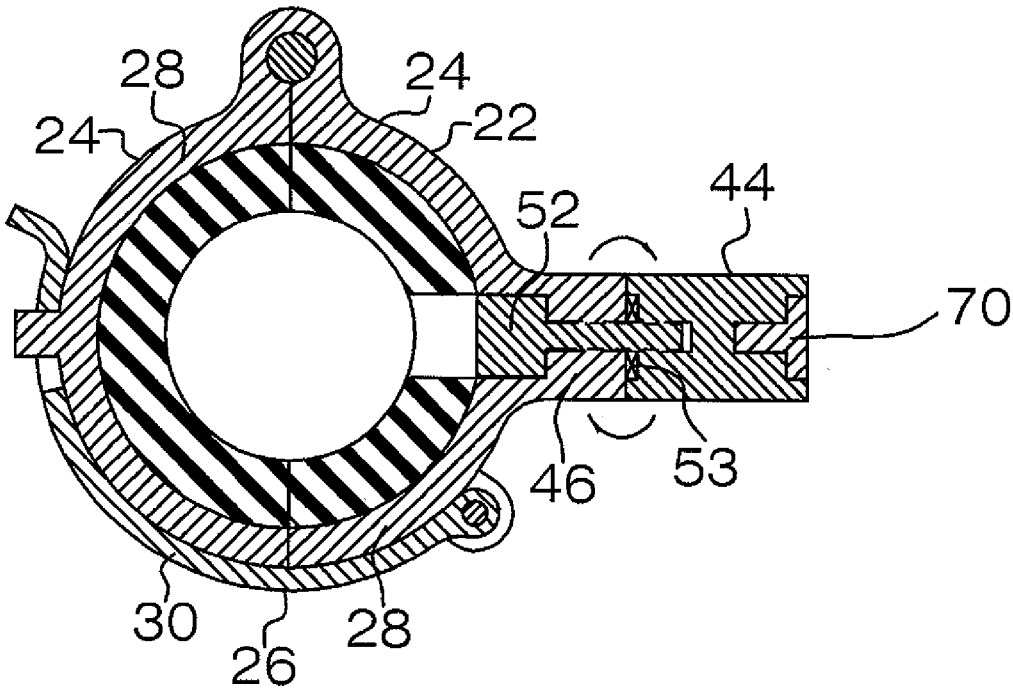
FIG. 11 is a cross-sectional view of an embodiment of the present invention as shown in FIG. 5.
Figure 12:
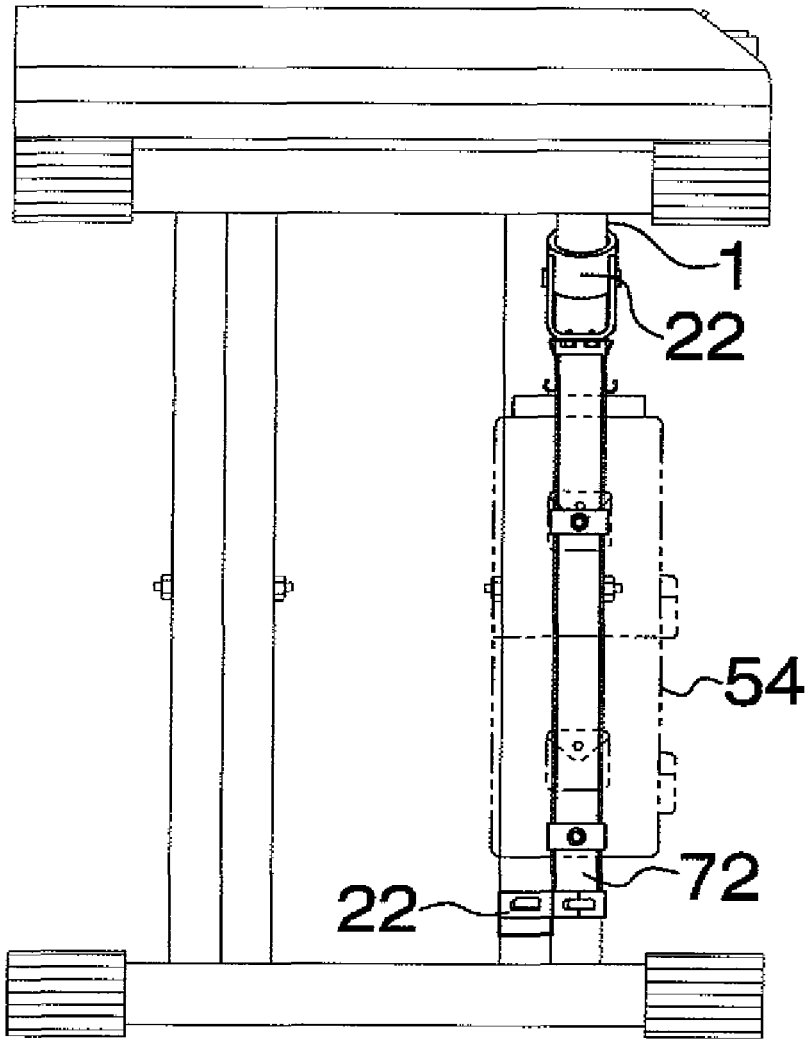
FIG. 12 is a side view of the present invention shown in FIG. 6.
Figure 13:
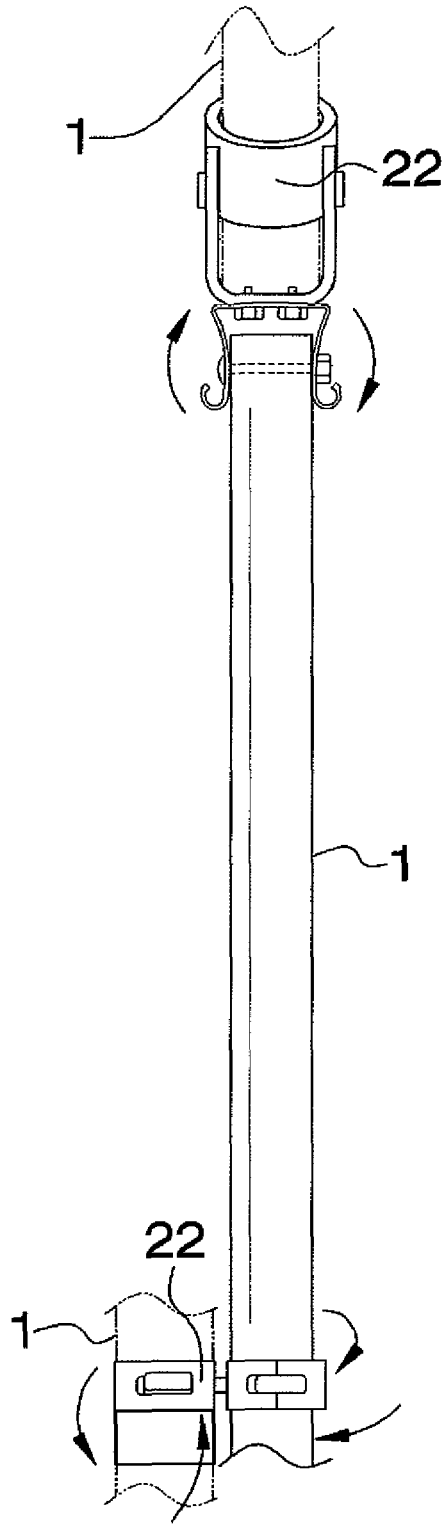
FIG. 13 is a side view of the accessory bar of the present invention.
Figure 14:
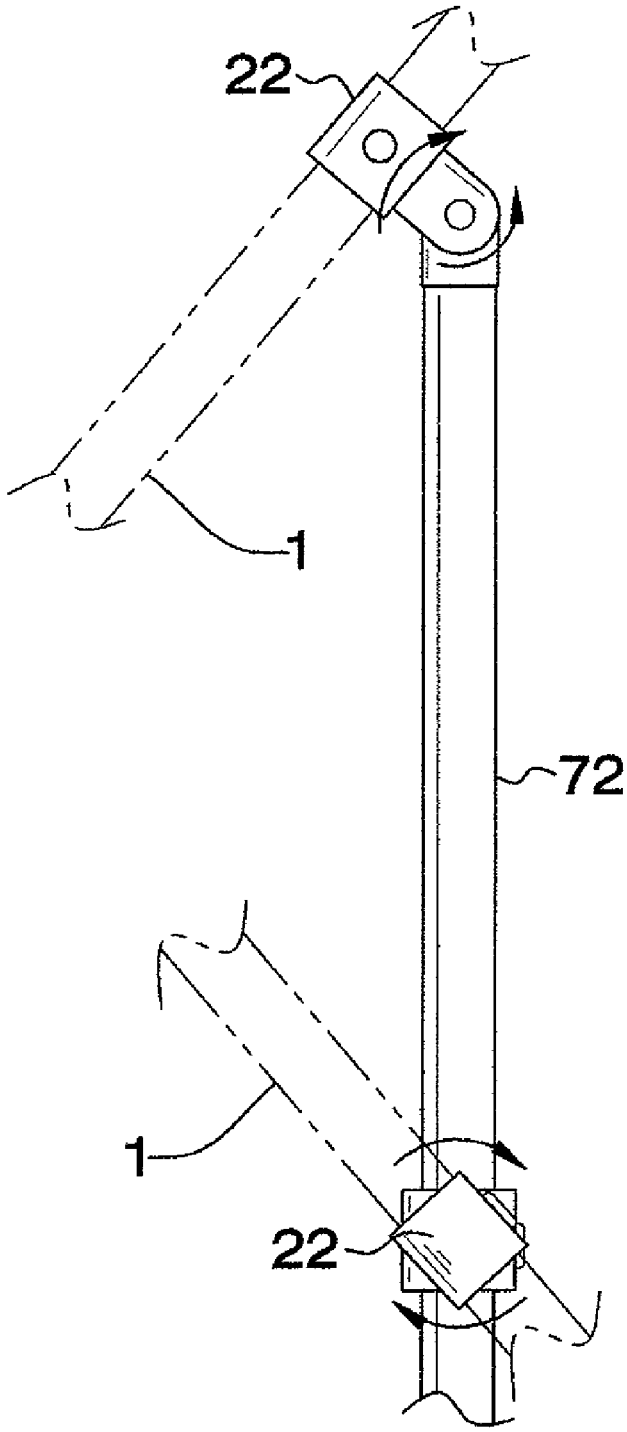
FIG. 14 is a rear view of the accessory bar of the present invention.
Figure 15:
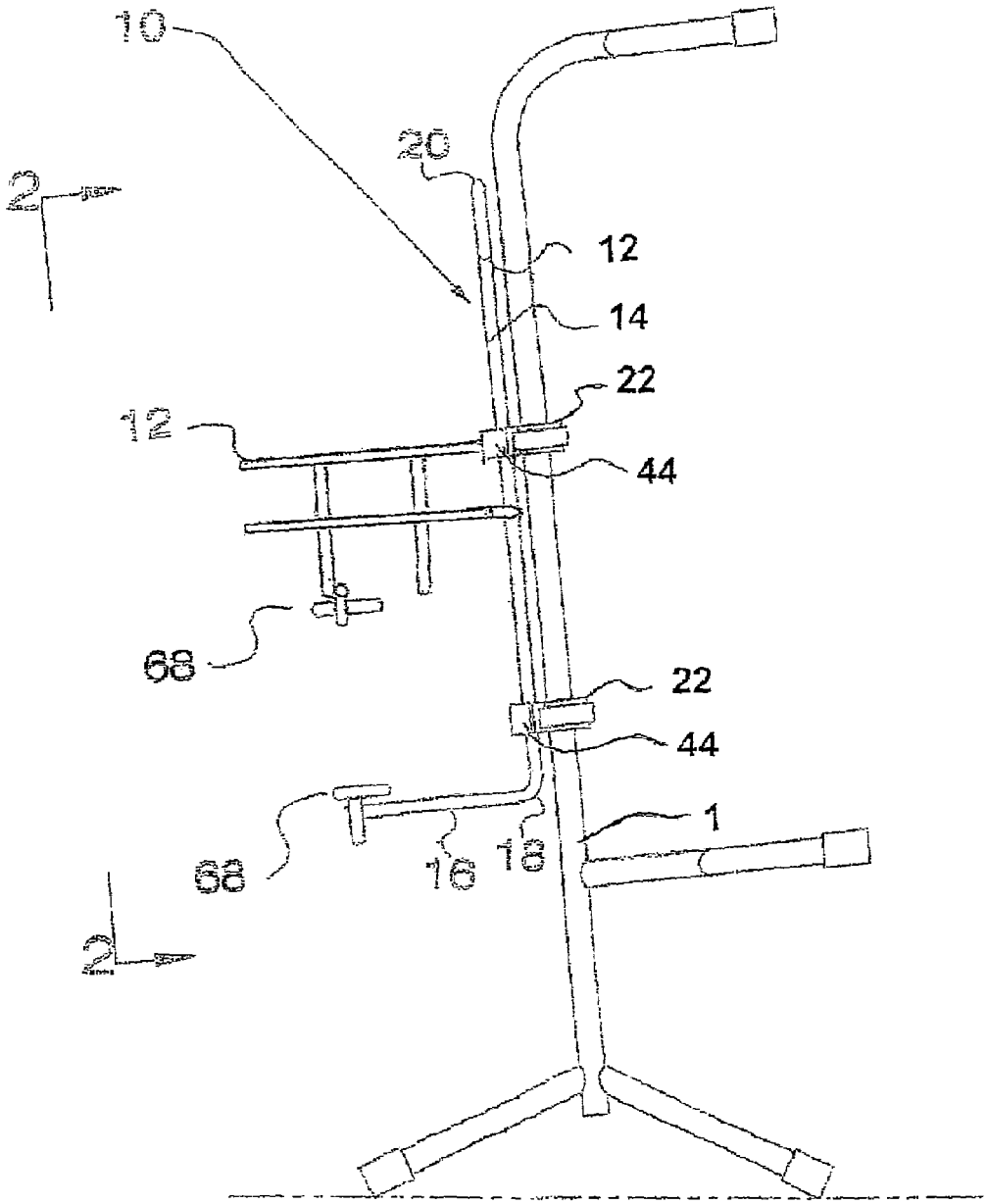
FIG. 15 depicts the drink container holding device of FIG. 1, with the sleeve removed.
Figure 16:
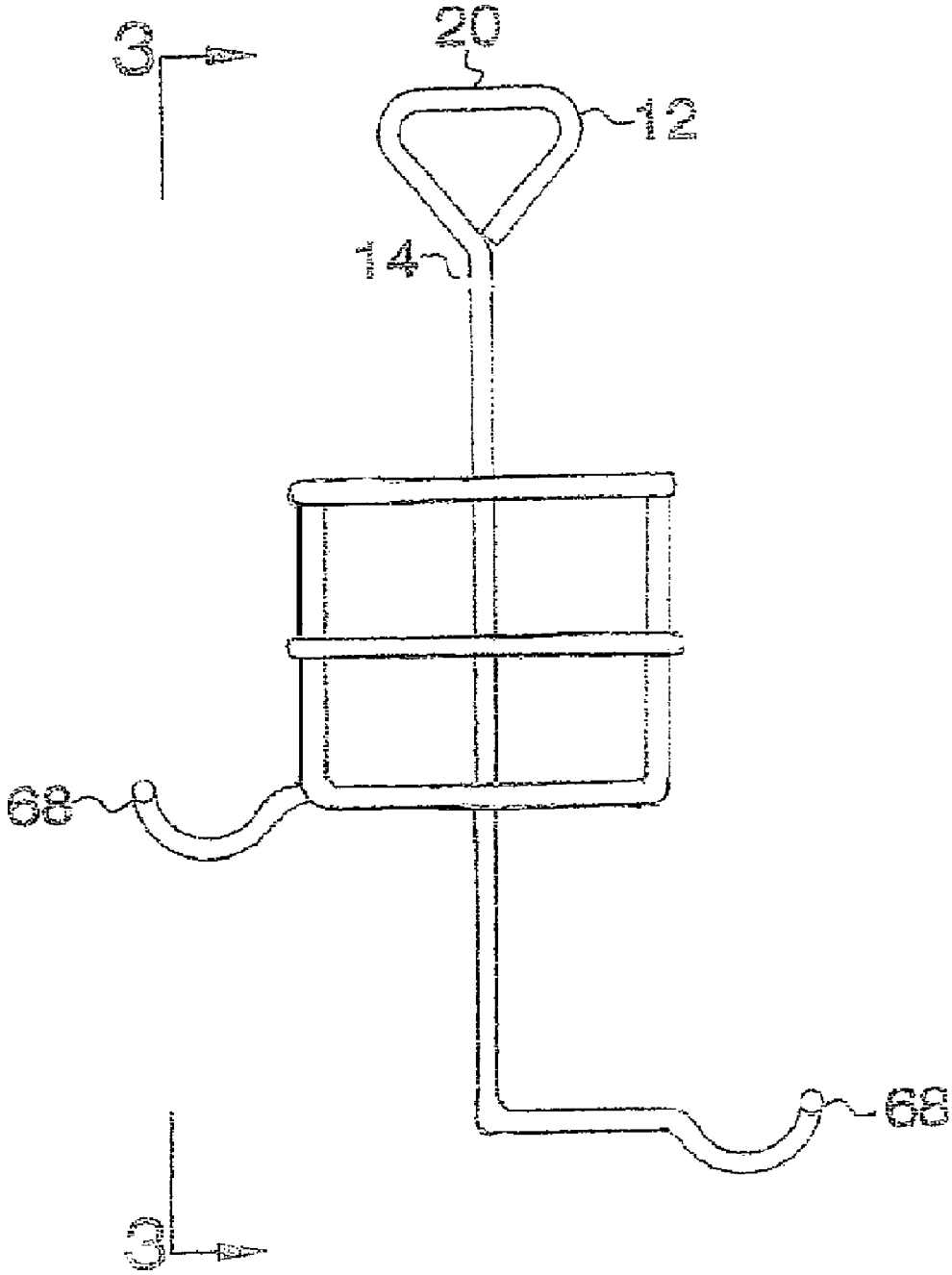
FIG. 16 depicts a view of the drink container holding device depicted in FIG. 2, with the sleeve removed.
Figure 17:
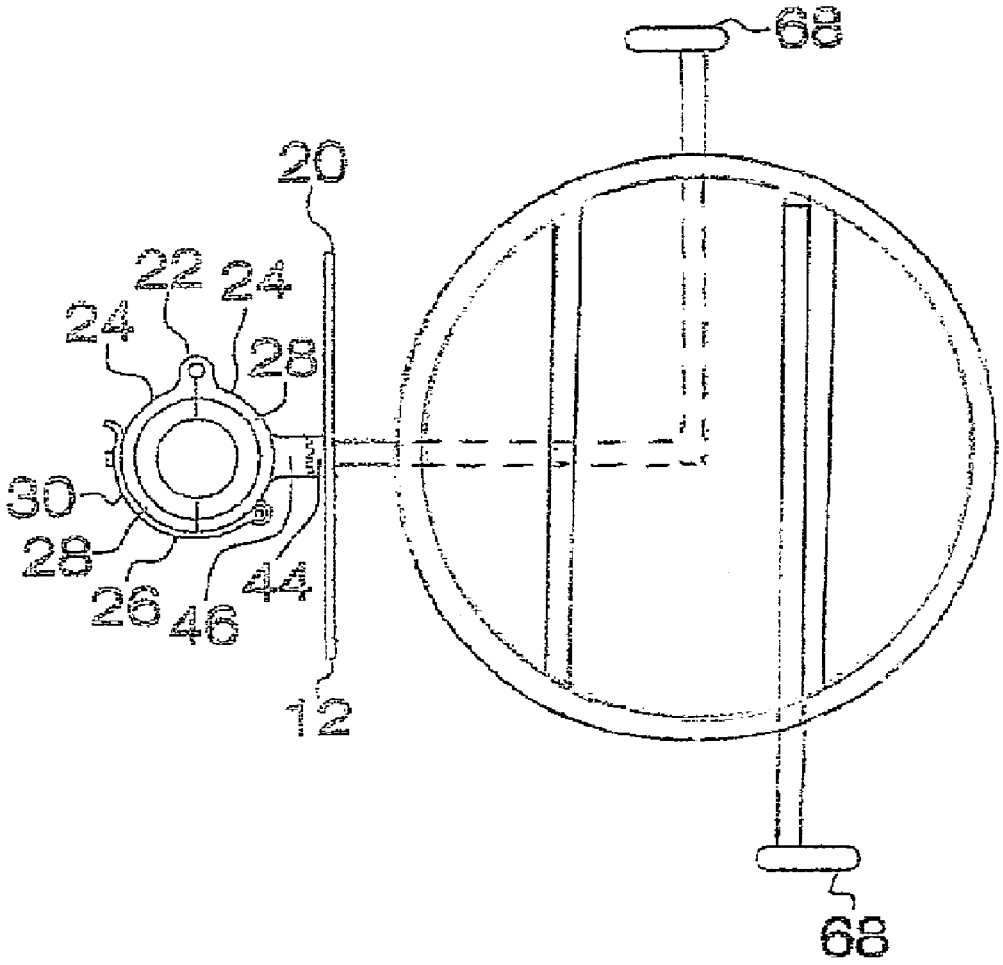
FIG. 17 depicts a top view of the drink container holding device depicted in FIG. 4, with the sleeve removed.

In an embodiment, as shown in FIG. 11, a bearing 53 is coupled to the base portion 44 and threadably receives the threaded fastener 52 to allow the angle of the frame 12 to freely adjust to keep the frame 12 in vertical orientation when the angle of the stand 1 is changed. Additionally, at least one securing fastener 70 may be extended through the stand 1 and into the base portion 44 to secure the base portion 44 to the stand 1.

A sleeve 54 is coupled to the frame 12. The sleeve 54 has a beverage aperture 56 extending therein through an upper end 58 of the sleeve 54. The beverage aperture 56 receives a drink container 2 to allow the sleeve 54 to support the drink container 2 adjacent to the stand 1 when the frame 12 is mounted on the stand 1. The sleeve 54 is comprised of an insulating material to insulate the drink container 2 placed in the beverage aperture 56. Each of a plurality of pockets 60 is coupled to an exterior surface 62 of the sleeve 54. Each of the pockets 60 receives articles 3 to be stored on the sleeve 54.

Each of a plurality of slits 64 extends into the sleeve 54 through the exterior surface 62 of the sleeve 54. The slits 64 receive a portion of additional ones of the articles 3 to be stored. Each of a plurality of rings 66 is coupled to the exterior surface 62 of the sleeve 54. Each of the rings 66 extends outwardly from the sleeve 54. Each of the rings 66 receives at least one of the articles 3 to support the associated one of the articles 3 from the sleeve 54. Each of a plurality of hooks 68 is coupled to and outwardly extending from the sleeve 54. Each of the hooks 68 engages at least one of the articles 3 to support the articles 3 from the sleeve 54 or a lateral portion 16 of the frame 12.

In an embodiment, as shown in FIGS. 6 and 12 through 14, a pair of the mounting assemblies 22 is coupled to opposing ends of an accessory bar 72. The mounting assemblies 22 coupled to the accessory bar 72 engage legs of an X-shaped stand 1 to mount the accessory bar 72 between the legs of said X-shaped stand 1. The mounting assemblies 22 coupled to the frame 12 engage the accessory bar 72 to mount the frame 12 to the accessory bar 72.

In use, the mounting assemblies 22 are mounted onto the stand 1 with the upper end 58 of the sleeve 54 positioned upwardly to allow the beverage aperture 56 to receive the drink container 2. The drink container 2 can be retrieved from the sleeve 54 for consumption of a beverage in the drink container 2. The articles 3 can be stored on the sleeve 54 through the use of the pockets 60, the slits 64, the rings 66 or the hooks 68.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drink container holding system for holding a beverage container comprising:

a frame;

at least one mounting assembly; and a sleeve coupled to said frame, said sleeve having a beverage aperture extending therein through an upper end of said sleeve, wherein said sleeve is configured such that it is capable of receiving a drink container in said beverage aperture to allow said sleeve to support a drink container substantially adjacent to a stand when said frame is mounted to the stand;

wherein at least one mounting assembly couples the sleeve to said frame, and wherein at least one mounting assembly is configured such that the mounting assembly may be engaged with a stand to mount said frame to the stand, and comprises:

a plurality of clamping arms, each of said clamping arms being extendable around a portion of the stand;

a securing portion being coupled to at least one of said clamping arms and selectively engaging at least one other one of said clamping arms for forcing said clamping arms against the stand to secure said clamping arms to the stand;

a base portion extending toward the stand when said frame is mounted to the stand; and a neck portion coupled to at least one of said clamping arms, said neck portion being rotatably coupled to said base portion, said neck portion being rotatable from 0 to 360 degrees with respect to said base portion to adjust an angle of said clamping arms with respect to said frame to maintain said frame in a desired orientation when mounted to the stand;

wherein said neck portion comprises a plurality of indexing pins outwardly extending from said neck portion, each of said indexing pins being inserted into one of a plurality of indexing slots in said base portion to permit orientation of said neck portion and said clamping arms at desired angles with respect to each other and with respect to said frame.

2. The system according to claim 1, wherein said frame comprises a stanchion portion extending substantially parallel to the stand when said frame is mounted to the stand, said at least one mounting assembly coupled to said frame being positioned on said stanchion portion of said frame.

3. The system according to claim 2, wherein said frame comprises a lateral portion being coupled to a bottom end of said stanchion portion and extending substantially orthogonally to said stanchion portion, said lateral portion extending away from the stand when said stanchion portion is mounted to the stand.

4. The system according to claim 3, wherein said frame comprises a handle loop being coupled to said stanchion portion opposite said lateral portion, said handle loop being graspable to facilitate lifting of said frame.

5. The system according to claim 1, wherein said at least one mounting assembly configured such that it may be engaged with a stand comprises a threaded fastener slidably extending through said neck portion and threadably engaging said base portion to secure said neck portion to said base portion.

6. The system according to claim 1, further comprising at least one pocket coupled to an exterior surface of said sleeve, wherein said pocket is configured to be capable of receiving at least a portion of at least one article to be supported by said sleeve.

7. The system according to claim 1, further comprising at least one slit extending into said sleeve through an exterior surface of said sleeve, wherein said at least one slit is configured to be capable of receiving at least a portion of at least one article to be supported by said sleeve.

8. The system according to claim 1, further comprising at least one ring coupled to an exterior surface of said sleeve, and extending outwardly from said sleeve, wherein said at least one ring is configured to be capable of receiving at least a portion of at least one article to be supported by said sleeve.

9. The system according to claim 1, further comprising at least one hook outwardly extending from said sleeve, at least one hook being coupled to and extending outwardly from said frame, wherein at least one hook engages at least one article to be supported by said frame.

10. The drink container holding system of claim 1, wherein said sleeve comprises an insulating material.

11. A stand accessory holding system comprising:

a frame;

a sleeve coupled to said frame, said sleeve having a beverage aperture extending therein through an upper end of said sleeve, wherein said sleeve is configured such that it is capable of receiving a drink container in said beverage aperture to allow said sleeve to support a drink container substantially adjacent to a stand when said frame is mounted to the stand; and a plurality of mounting assemblies coupled to said frame and configured such that the plurality of mounting assemblies may be engaged with the stand to mount said frame to the stand, such that the plurality of mounting assemblies are capable of supporting weight of at least one of a drink container and accessory received in said sleeve;

wherein said stand to which said frame may be mounted, comprises at least one pair of legs at two or more different angles, and wherein said plurality of mounting assemblies are configured for adjustable attachment to said legs at a desired height with respect to said stand, the plurality of mounting assemblies are configured such that angles of the plurality of mounting assemblies are adjustable with respect to the stand from 0-360 degrees to simultaneously mount said mounting assemblies to each leg of said stand at desired angles, to be able to maintain said drink container holding system level with respect to the ground when the drink container holding system is mounted to the legs of the stand.

12. A drink container holding system for holding a beverage container comprising:

a frame;

at least one mounting assembly; and a sleeve coupled to said frame, said sleeve having a beverage aperture extending therein through an upper end of said sleeve, wherein said sleeve is configured such that it is capable of receiving a drink container in said beverage aperture to allow said sleeve to support a drink container substantially adjacent to a stand when said frame is mounted to the stand;

wherein at least one mounting assembly couples the sleeve to said frame, and wherein at least one mounting assembly is configured such that the mounting assembly may be engaged with a stand to mount said frame to the stand, and comprises:

a plurality of clamping arms, each of said clamping arms being extendable around a portion of the stand;

a securing portion being coupled to at least one of said clamping arms and selectively engaging at least one other one of said clamping arms for forcing said clamping arms against the stand to secure said clamping arms to the stand;

a base portion extending toward the stand when said frame is mounted to the stand; and a neck portion coupled to at least one of said clamping arms, said neck portion being rotatably coupled to said base portion, said neck portion being rotatable from 0 to 360 degrees with respect to said base portion to adjust an angle of said clamping arms with respect to said frame to maintain said frame in a desired orientation when mounted to the stand;

wherein said neck portion comprises a bearing to permit orientation of said neck portion and said clamping arms at desired angles with respect to each other and with respect to said frame.

* * * * *